United States Patent [19]

Hollander

[11] Patent Number: 4,932,130

[45] Date of Patent: Jun. 12, 1990

[54] KEY FOR GRIPPING AND PIERCING A BEVERAGE CAN

[76] Inventor: Jason E. Hollander, 32 Lake Forest, St. Louis, Mo. 63117

[21] Appl. No.: 275,336

[22] Filed: Nov. 23, 1988

[51] Int. Cl.[5] ..... B67B 7/50

[52] U.S. Cl. ..... 30/450

[58] Field of Search ..... 30/450, 430; 81/3.07, 81/3.48

[56] References Cited

U.S. PATENT DOCUMENTS

| | | | |
|---|---|---|---|
| 2,707,827 | 5/1955 | Petram | 30/450 |
| 2,734,204 | 2/1956 | Epstein | 30/450 |
| 2,867,900 | 1/1959 | Hanington | 30/450 |
| 3,305,924 | 2/1967 | Caravella | 30/450 |

*Primary Examiner*—Roscoe V. Parker

*Attorney, Agent, or Firm*—Kalish & Gilster

[57] ABSTRACT

A key for gripping a beverage can end while simultaneously allowing piercing of the can body. The key has a rigid shaft, one end adapted for use as a handle, and a forked construction at the other end defining two arms. The first arm is adapted to pierce a can body as the second arm engages the can rim. The second arm has at its end a rim-gripping formation shaped to grip the can rim and serve as a fulcrum as the handle is rotated causing the first arm to pierce the can and form an opening therein.

3 Claims, 1 Drawing Sheet

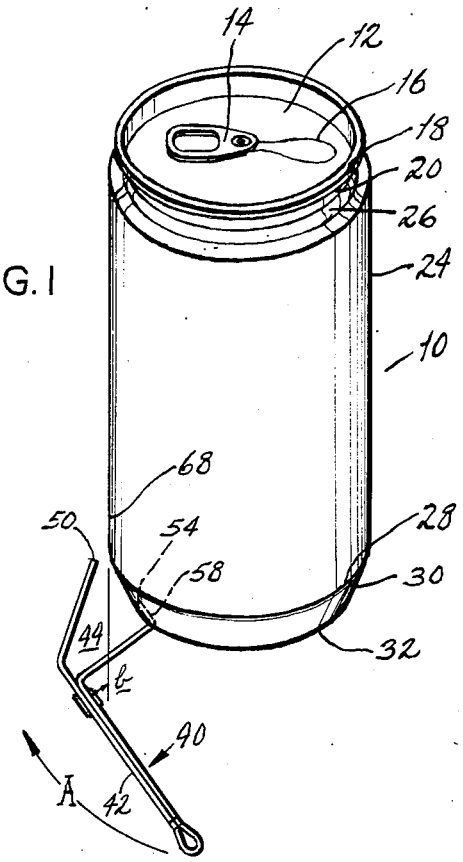
FIG. 1
FIG. 2
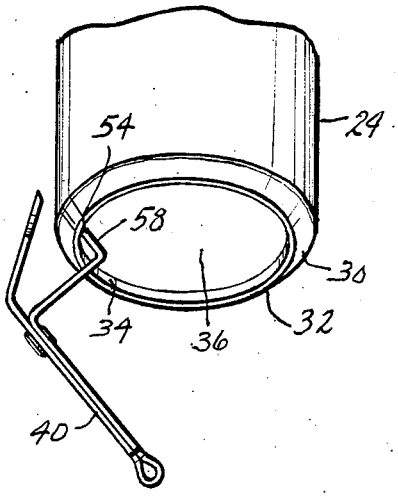
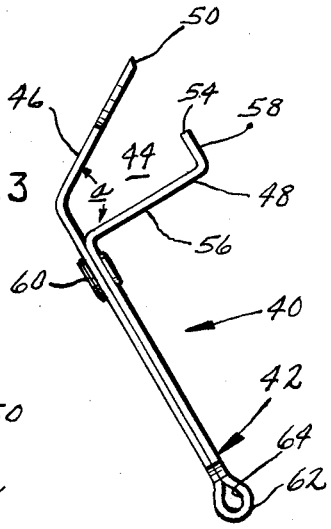
FIG. 3
FIG. 4
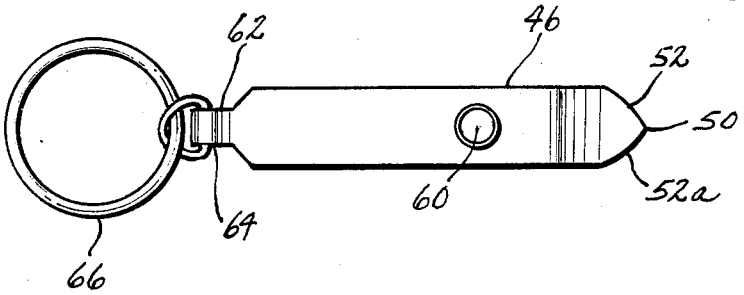
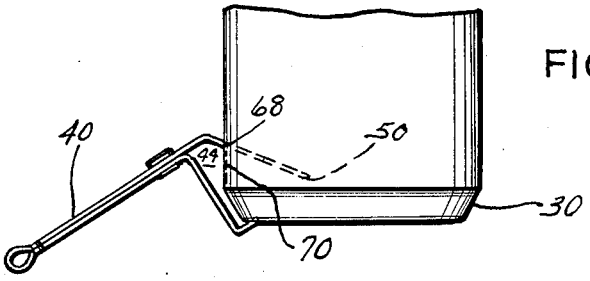
FIG. 5

KEY FOR GRIPPING AND PIERCING A BEVERAGE CAN

FIELD OF THE INVENTION

The present invention relates in general to opening beverage cans and, more particularly, to a key that grips the can bottom while simultaneously allowing piercing of the can body.

BACKGROUND OF THE INVENTION

1. Description of the Prior Art

Heretofore there have been numerous devices for removing lids from containers, extracting stoppers from bottles, lifting bottle caps from bottles and removing ends from cylindrical containers. One such prior effort is revealed in Obey U.S. Pat. No. 4,492,132 which discloses a tool for removing heavy-gauge lids from bulk containers. The tool has a pair of arms for gripping and removing the lid. There is no suggestion therein for gripping the container while simulataneously piercing the container body.

Stephens U.S. Pat. No. 952,085 discloses a tool that can remove a crown cap from a bottle that is also adapted to close the bottle after removal of the crown cap.

Hunt U.S. Pat. No. 933,988 pertains to a tool that is suitable for removing corrugated caps from bottles by engaging the rim of a cap and enabling an upward prying movement for loosening and removing the cap.

Reference is also made to Kirkpatrick et al, U.S. Pat. No. 2,897,700 wherein a tool is shown for piercing and removing a portion of a tube. The tool bears on the edge of the tube, pierces the tube end wall and enables removal of the pierced end thereby providing an open end for easy removal of the contents thereof.

The foregoing thus exemplify that the teachings of the prior art reveal tools for removing lids from containers and crown caps from bottles, extracting stoppers from bottles and piercing tubes and removing the pierced end portion. The prior art has failed to disclose a tool that grips the rim of a can while simultaneously permitting the can body to be pierced and opened.

SUMMARY OF THE INVENTION

The present invention provides a key for gripping a beverage can and simultaneously piercing the can body. The invention includes a key having a forked construction at one end which defines two arms. One arm is configured to engage the rim of the can while the other arm has a pointed end which pierces the can as the rim gripping arm is moved upwardly.

Accordingly, it is an object of the present invention to provide a key that is capable of gripping a beverage can end while simultaneously permitting the can body to be pierced and opened.

It is another object of the present invention to provide a key that has a forked construction defining two arms, wherein one arm grips a can end and the second arm pierces and opens the can body.

It is a still further object of the present invention to provide a key for piercing the body of a stackable beverage can.

BRIEF DESCRIPTION OF THE DRAWINGS

FIG. 1 is a perspective view of the key showing the rim gripping arm engaging the rim of a beverage can;

FIG. 2 is a perspective view of a beverage can bottom showing the rim gripping arm of the key engaging the bottom rim;

FIG. 3 is a perspective view of the key showing the forked end construction;

FIG. 4 is a top view of the key showing the pointed piercing arm;

FIG. 5 is a perspective view showing operation of the key wherein the can body has been pierced and opened.

DETAILED DESCRIPTION OF THE PREFERRED EMBODIMENT OF THE INVENTION

Referring now by reference characters to the drawings which illustrate the preferred embodiment of the present invention, 10 indicates a stackable beverage can. As used herein a can of this nature is usually extruded or punched out from a light metal blank such as aluminum. Can 10, includes a top 12, having a pull tab 14 and a scored section 16 that defines an opening (not shown) that is formed when the tab is pulled off the can top. The top also include a downwardly extending rim 18 that terminates in a continuous lip 20 . Top 12 can be attached to a body portion 24 in any conventional manner such as by adhesives or roll forming and such attachment is not part of this invention.

Body portion 24, generally an aluminum extrusion, has a series of annular grooves 26 below the juncture of the top and body portion for providing rigidity to the beverage can. The vertical surface of the can body terminates at annular ring 28. As shown in FIG. 1, extending downwardly is concave, tappered surface 30 which defines the lower lip 32 of the can. Extending upwardly from lip 32 is a bottom rim 34 and concave bottom surface 36. The configuration of the can bottom, namely concave tapered surface 30, bottom rim 34 and concave bottom surface 36 enable these beverage cans to be readily stacked for display and sale. This can bottom configuration is adapted to nest within a beverage can top having a similar geometric configuration.

Referring now to FIG. 3, a key 40 for gripping can 10 and piercing body portion 24 is shown to comprise a handle 42 and a forked construction 44 defining two arms, first arm 46 and second arm 48 that are configurated to engage top rim 18 or bottom rim 34. The key disclosed herein is generally used to engage bottom rim 34.

First arm 46 laying at an acute angle "a" to handle 42, has at its outer end a can piercing point 50. As more clearly shown in FIG. 4 this point is formed by the juncture of cutting edges 52 and 52*a*. First arm 46 is adapted to pierce the can body and subsequently form an opening in the vertical body portion as hereinafter more fully described.

Second arm 48 is positioned perpendicularly to handle 42 and has at its end a rim gripping formation 54. This second arm comprises a first portion 56 that is dimensioned so as to position the can piercing point 50 at a location on the beverage can body approximately adjacent the can rim whereby piercing and opening a section of the can body is accomplished at the most optimum area. Positioned perpendicularly to first portion 56 is second portion 58. As shown in FIGS. 1 and 2 this second portion engages the rim of the beverage can so that the key can function as a piercing and opening device.

The key 40 may be typically manufactured from a cold rolled steel blank e.g. 1/16" by ½" by 6". Can piercing end 50 is formed by preparing cutting edges 52 and 52*a* in a conventional manner as by diagonally trimming off these corners of the steel blank. This trimmed end is then formed to an acute angle "a". A rim gripping end is then formed on the opposite end of the steel blank. The second arm 48 is then formed at a right angle to the steel The fork configuration 44 is then achieved by bending the steel blank at approximately its mid point by moving the rim gripping end toward the can piercing end. Handle 42 is formed when the bent sections of the steel blank are in colinear alignment. A fastener, such as a rivet 60, may be inserted in a hole punçhed in the handle at a location adjacent to the forked end so as to maintain the handle in a fixed position and likewise maintaining the forked relationship of arms 46 and 48. At the handle end 62 opposite the forked end a loop 64 may be formed for positioning a key chain 66 or the like for carrying the key of this invention.

Operation

Referring to FIGS. 1 and 5, key 40 is brought into use by engaging forked construction 44 about beverage can bottom rim 34 with the handle 42 forming an acute angle "b" to the beverage can body. With rim gripping form 54 engaging the can rim, can piercing point 50 contacts the beverage can wall at location 68. As key handle 42 is moved in a clockwise motion, indicated by arrow A, with rim gripping formation 54 acting as a fulcrum, can piercing point 50 is caused to pierce the wall of the beverage can. This causes cutting edges 52 and 52*a* to enter the can body at location 68 and form an opening 70 as shown by a dotted line in FIG. 5 within the wall of the can body.

Prior to engaging key 40 about bottom rim 34, pull tab 14 is removed from can top 12 in a conventional manner. Removing the pull tab simultaneously releases pressure within can 10 and forms an opening on top of the can. Thus, when opening 70 is formed on the wall of the can body beverage readily flows out of the can.

I claim:

1. For opening beverage cans of the type having a top surface, a bottom surface and a vertically extending continuous rim, a key for gripping and piercing said can, comprising; a rigid shaft, one end of said shaft adapted for use as a handle, and a forked construction at the other end of said shaft, defining two arms configured and arranged to engage said rim, the first arm located at an acute angle to said handle, terminating at a pointed end adapted to pierce the wall of said can and form an opening, the second arm, positioned perpendicularly to said handle, having at its outer end a rim-gripping formation shaped to grip said rim and adapted to serve as a fulcrum during piercing of said can by said first arm whereby an opening is formed in said can as said handle is rotated about said fulcrum.

2. The key of claim 1 further comprising a first portion that is dimensioned so as to position said first arm at a location on said beverage can wall that is adjacent said rim and a second portion that is perpendicular to said first portion that is adapted to engage said rim.

3. For opening stackable beverage cans of the type having a top surface with a pull tab opener positioned thereon and a bottom surface having a downwardly extending rim, a key for gripping and piercing said can, comprising: a rigid shaft, one end of said shaft adapted for use as a handle, and a forked construction at the other end of said shaft, defining two arms configured and arranged to engage said bottom rim, the first arm of said forked construction having at its end a pointed cutting edge adapted to pierce the wall of said can and form an opening, the second arm of said forked construction having at its outer end a rim-gripping formation positioned perpendicularly to said handle having a first portion that is dimensioned so as to position said first arm at a location on said beverage can wall that is adjacent said rim and a second portion that is perpendicular to said first portion adapted to grip said bottom rim and serve as a fulcrum during piercing of said can by said first arm whereby an opening is formed in said can as said handle is rotated about said fulcrum.

* * * * *